US010415254B2

(12) United States Patent
Belman et al.

(10) Patent No.: US 10,415,254 B2
(45) Date of Patent: Sep. 17, 2019

(54) DEVICE FOR HELPING A VEHICLE PASS OVER AN OBSTACLE

(71) Applicant: MYD"L", Saint Denis (FR)

(72) Inventors: Pierre Belman, Saint Denis (FR); Frederic Engler, Saint Denis (FR)

(73) Assignee: MYD"L", Saint Denis (FR)

( * ) Notice: Subject to any disclaimer, the term of this patent is extended or adjusted under 35 U.S.C. 154(b) by 0 days.

(21) Appl. No.: 15/780,261

(22) PCT Filed: Nov. 30, 2016

(86) PCT No.: PCT/FR2016/053150
§ 371 (c)(1),
(2) Date: Jul. 24, 2018

(87) PCT Pub. No.: WO2017/093664
PCT Pub. Date: Jun. 8, 2017

(65) Prior Publication Data

US 2018/0347203 A1 Dec. 6, 2018

(30) Foreign Application Priority Data

Dec. 1, 2015 (FR) ..... 15 61690

(51) Int. Cl.
*E01D 1/00* (2006.01)
*E04F 11/00* (2006.01)

(52) U.S. Cl.
CPC ..... *E04F 11/002* (2013.01)

(58) Field of Classification Search
CPC ..... B65G 69/2823; B65G 69/2829; B65G 69/34; A61G 3/061
(Continued)

(56) References Cited

U.S. PATENT DOCUMENTS 1,262,930 A * 4/1918 Diaz ..... E01C 9/00 14/69.5
2,626,411 A * 1/1953 Palmer ..... B65G 69/2858 14/71.7
(Continued)

FOREIGN PATENT DOCUMENTS

DE 10255516 6/2004
FR 2947224 12/2010
(Continued)

OTHER PUBLICATIONS

International Search Report for PCT/FR2016/053150 dated Feb. 17, 2017, 4 pages.

*Primary Examiner* — Robert E Pezzuto
*Assistant Examiner* — Katherine J Chu
(74) *Attorney, Agent, or Firm* — Dority & Manning, P.A.

(57) ABSTRACT

The invention relater to a device (1) for helping a wheeled vehicle pass over an obstacle, in particular for a person with impaired mobility. It comprises: —a stationary frame (2) comprising a bottom and two side walls (9, 10), —a plate (3) provided with two ends, a first end being movable between a high position and a low position in which said plate constitutes a first access ramp, —an assembly for driving the vertical translational movement at least of said first end supported by said assembly, —a flap (4) forming a front surface of the device in the high position of the plate and forming a second access ramp in the low position of the plate, the flap (4) being pivotably mounted on the plate at the first end of said plate, and —a mechanism for deploying the flap (4), comprising at least one connecting rod including a front end hingedly connected to the flap (4), the hinge being separated from the upper edge and from the lower edge of said flap (4), a rear end linked to a first slide slidably mounted in a linear guide provided in the plate, and a central portion linked to a second slide (45) slidably mounted in a
(Continued)

guide (19) provided in one side of the frame, the connecting rod moving in a substantially vertical plane.

18 Claims, 5 Drawing Sheets

(58) Field of Classification Search
USPC ..... 14/69.5, 71.1, 71.3; 187/200; 414/921
See application file for complete search history.

(56) References Cited

U.S. PATENT DOCUMENTS 3,955,827 A * 5/1976 Wonigar ..... B60R 3/02 280/166
3,997,932 A * 12/1976 Artzberger ..... B65G 69/2841 14/71.3
4,827,549 A * 5/1989 Walker ..... B65G 69/2823 14/71.7
4,847,935 A * 7/1989 Alexander ..... B65G 69/2841 14/71.3
4,944,062 A * 7/1990 Walker ..... B65G 69/2823 14/71.3
4,974,276 A * 12/1990 Alexander ..... B65G 69/2841 14/71.3
5,440,772 A * 8/1995 Springer ..... B65G 69/2882 14/69.5
5,586,356 A * 12/1996 Alexander ..... B65G 69/2841 14/71.1
5,657,502 A * 8/1997 Ellis ..... B65G 69/2841 14/71.1
5,813,072 A * 9/1998 Alexander ..... B65G 69/2894 14/71.1
6,081,954 A * 7/2000 Palmersheim ..... B65G 69/2829 14/69.5
6,125,491 A * 10/2000 Alexander ..... B65G 69/2841 14/69.5
6,311,352 B1 * 11/2001 Springer ..... B65G 69/2823 14/69.5
6,487,741 B2 * 12/2002 Alexander ..... B65G 69/2841 14/71.3
6,558,106 B2 * 5/2003 Sardonico ..... B60P 1/445 254/10 R
6,834,409 B2 * 12/2004 Gleason ..... B65G 69/2841 14/71.3
6,842,930 B2 * 1/2005 Massey ..... B65G 69/2888 14/71.1
7,500,818 B1 * 3/2009 Johnson ..... A61G 3/06 414/546
8,407,842 B2 * 4/2013 Story ..... B65G 69/2841 14/71.1
8,763,186 B2 * 7/2014 Mosey ..... A61G 3/061 14/71.3
8,821,103 B1 * 9/2014 Matthews ..... B60P 3/36 414/558
8,832,893 B1 * 9/2014 Morris ..... B66B 9/08 14/71.3
8,887,337 B1 * 11/2014 Morris ..... E04F 11/002 14/71.1
8,918,939 B1 * 12/2014 Morris ..... E04F 11/002 14/71.1
9,580,910 B1 * 2/2017 Morris ..... E04F 11/002
9,587,404 B1 * 3/2017 Franco ..... E04F 11/002
9,708,815 B1 * 7/2017 Morris ..... E04F 11/002
9,963,883 B1 * 5/2018 Franco ..... E04F 11/002
10,040,646 B2 * 8/2018 Yule ..... B65G 69/2811
2002/0092102 A1 * 7/2002 Lounsbury ..... B65G 69/2841 14/71.3
2003/0066144 A1 * 4/2003 Widule ..... B65G 69/2823 14/71.1
2011/0258788 A1 * 10/2011 Ion ..... B65G 69/2823 14/71.3
2012/0131755 A1 * 5/2012 Luu ..... B65G 69/2823 14/71.3
2013/0097787 A1 * 4/2013 Sveum ..... B05D 5/02 14/71.3
2015/0013083 A1 * 1/2015 Palmersheim ..... B65G 69/2817 14/71.3
2015/0040329 A1 * 2/2015 Palmersheim ..... B65G 69/2817 14/71.3

FOREIGN PATENT DOCUMENTS

GB 1294317 A * 10/1972 ..... B65G 69/2823
GB 2491706 12/2012
WO WO2015/162378 10/2015

* cited by examiner

DEVICE FOR HELPING A VEHICLE PASS OVER AN OBSTACLE

CROSS REFERENCE TO RELATED APPLICATIONS

This application is the U.S. National Stage entry of International Application Number PCT/FR2016/053150 filed under the Patent Cooperation Treaty having a filing date of Nov. 30, 2016, which claims priority to French Patent Application Number 1561690 having a filing date of Dec. 1, 2015, which are incorporated herein by reference.

BACKGROUND

The present invention relates to a device for helping a vehicle, in particular a vehicle for persons with impaired mobility moving with the aid of a wheelchair or, alternatively, persons moving a wheeled carriage for carrying objects, pass over one or more steps or a threshold.

Frequently, a store or a business, and even an entrance to a dwelling, has a street access that includes one or more steps.

A threshold of this type has a height ranging generally from one to several tens of centimeters and constitutes an obstacle that is often impassable for a person with impaired mobility or for delivery carriages.

Obviously, this problem does not relate solely to exterior access points, and such steps may also exist even inside these spaces, in particular in old buildings. There may also be steps for accessing terraces.

One solution for enabling a vehicle or a wheeled carriage to pass over a step of this type consists in installing an access ramp.

A major constraint in terms of installing such a ramp is that there cannot be permanent encroachment onto the public thoroughfare, sidewalk and/or highway, corridor, etc.

Indeed, although ramps are essential for a person with impaired mobility, their general level of use is still relatively low. It is thus appropriate to be able to provide totally clear passage when these ramps are not in use.

Deployable and retractable ramps offer a valuable service, but are mechanically complex. Such ramps require a significant clear distance for deployment, which restricts implementation possibilities. An uneven sidewalk places stresses on their structure.

FR 2947224 describes a rocking telescopic ramp.

There is a need for a device, for providing help in passing over an obstacle, that occupies a very small space on the sidewalk for a given height to be passed over. The applicant realized that a device of this type would expand the market by widening the range of situations in which the device would be appropriate.

SUMMARY

A device for helping a wheeled vehicle, in particular for a person with impaired mobility, to pass over an obstacle comprises a stationary frame comprising a bottom and two symmetrical parallel side walls, a plate provided with two ends, a first end being movable between a high position and a low position in which said plate constitutes a first access ramp, an assembly for driving, in vertical translation, at least said first end supported by said assembly, a flap forming the front face of the device in the high position of the plate and forming a second access ramp in the low position of the plate, the flap being mounted pivotably on the plate at the first end of said plate, and a mechanism of deployment of the flap, comprising at least one rod comprising a front end articulated on the flap, the articulation being distant from the top edge and from the bottom edge of said flap, a rear end linked to a first slide mounted slideably in a linear guide provided in the plate, and a central portion linked to a second slide mounted slideably in a guide provided in a side of the frame, the rod moving in a substantially vertical plane.

This thus provides a help device with a ramp having a change in height that is non-raisable with a flap acting as closure member in the high position and as supplementary ramp in the low position and indexed on the plate. The flap increases the height that can be passed over.

The flap prevents the ingress of foreign bodies under the plate.

In one embodiment, the slides are pegs. The pegs are mounted on the rod. The mechanism is compact.

In one embodiment, the linear guide is substantially horizontal in the high position of the plate. The mounting of the guide is simple.

In one embodiment, the guide of the frame is in the form of an arc of a circle with a substantially vertical lower end, preferably with a radius of between 30 and 280 mm. The movement of the flap ensures a clear path toward the front at the start of the descent of the plate and allows the free end of the flap to bear on the floor at the end of the descent.

In one embodiment, the guide of the frame has an upper end sloping by an angle of between 50 and 75° relative to the vertical. The movement of the flap ensures a rapid clear path toward the front at the start of the descent of the plate.

In one embodiment, the axis of articulation of the flap is arranged at a height of between and 60% of the distance between the top edge and the bottom edge of said flap. In the event of higher mounting, the moment that is exerted significantly diminishes. In the event of lower mounting, the articulation is likely to be in frictional contact with the floor.

In one embodiment, the rod sloping by an angle of between 10 and 350 relative to the horizontal in the high position of the plate and the rod being substantially horizontal in the low position of the plate. The travel of the rod is less than the travel of the free end of the flap. The rod may be of simple and robust form.

In one embodiment, the rod is made from a cut-out metal-sheet blank. The rod is inexpensive to manufacture.

In one embodiment, the rod is a rectilinear arm. The rod is not subject to a great deal of flexing.

In one embodiment, the linear guide provided in the plate comprises an elongate flat in which a rectilinear aperture accommodating the slide is provided. The guide takes up the stresses while at the same time preventing buckling forces.

In one embodiment, said flat is formed by bending an edge of the plate.

In one embodiment, two symmetrical rods are provided, one rod on either side of the frame. The likelihood of the flap warping is reduced.

In one embodiment, the drive assembly comprises a linear ram mounted under the plate, provided with a stationary end close to said second end and rigidly connected to the bottom, and a mobile end, a carriage that is movable in horizontal translation and driven by said ram, said carriage resting on guides mounted on the bottom of the frame, said carriage comprising two pushers, and a pair of arms, the arms being symmetrical, each arm resting on one of the pushers of the carriage, each arm supporting the first end of the plate; in the retracted position of the actuator, the carriage being close to said second end, the arms being in the low position and the first end being in the ramp position, and in the extended position of the actuator the carriage being close to said first end, the arms being in the raised position and the first end being in the raised position.

In one embodiment, the arms are mounted pivotably on the sides of the frame on a substantially horizontal common axis. The pivoting operation is reliable. The manufacturing costs are kept down.

In one embodiment, each arm is accommodated in a side of the frame.

In one embodiment, each arm comprises a body made from a cut-out metal-sheet blank.

The arm is of simple construction and compact.

Advantageously, the finger supporting the first end of the plate is provided with a journal.

Advantageously, the finger in contact with the pusher is provided with a journal.

In one embodiment, the finger comprises a base and a peg passing through a perforation in the body of the arm, the base being welded to said body.

In one embodiment, the fingers of an arm are connected by their opposite ends to said body. The rigidity of the arm is improved.

In one embodiment, each arm comprises a finger receiving the thrust of the pusher of the carriage and a finger supporting the first end of the plate.

In one embodiment, each arm is mounted between a side wall of the frame and a cover parallel to said side wall.

In one embodiment, at least one aperture in the form of an are of a circle is provided in said cover, the fingers projecting through said aperture.

In one embodiment, the axis of pivoting of the arm is supported bilaterally.

In one embodiment, each arm has a triangular form, an apex being located at the axis of pivoting. The arm may be manufactured by cutting metal sheet into complementary forms, thereby reducing the wastage of material.

In one embodiment, the triangle is an isosceles triangle.

In one embodiment, the angle formed between a straight line passing through the axis of pivoting of an arm and the pusher of the carriage and a straight line passing through the axis of pivoting of an arm and the arm-plate point of contact being between 50 and 70°. Preferably, the straight line passing through the axis of pivoting of an arm and the pusher of the carriage has an angular travel, in the course of pivoting, between 50 and 70°.

In one embodiment, the straight line passing through the axis of pivoting of an arm and the pusher of the carriage slopes relative to the vertical, in the course of pivoting, by an angle of between −30 and +30°. The horizontal movement of the ram is converted into a movement with a vertical component for the plate, with maximum force in the low position.

In one embodiment, the carriage comprises a chassis made from folded metal sheet. The carriage is reliable and robust.

In one embodiment, the chassis comprises a base substantially parallel to the bottom of the stationary frame, a rear border provided with an aperture allowing the ram to pass through and a front border comprising two zones forming the pushers. The pushers are kept compact. The overall height dimension is low.

In one embodiment, the front border is substantially vertical.

In one embodiment, the ratio of amplification of the arms is between 100 and 110%, preferably more than 100 and less than 105%. The construction is compact. The travel of the ram is limited.

In one embodiment, each arm is mounted on a side of the frame on an axis fastened to said frame. Fastening is robust.

In one embodiment, the arms forming rods are mounted in an articulated manner on the carriage and on the plate.

In one embodiment, the plate comprises a second end mounted pivotably at the rear of the frame about a horizontal axis.

The plate can slope in order to form an access slope that can easily be passed over.

In one embodiment, the frame comprises two segments of an axis of pivoting supporting the second end of the plate and two pairs of vertical platens, each pair of platens supporting a segment of an axis of pivoting, the platen of one pair being distant from the other platen of said pair, the platens extending as far as the bottom of the frame such that the compressive forces are transferred to said bottom.

In one embodiment, the linear ram is electric.

In one embodiment, the carriage has a rectangular general form with a length greater than its width, the length of the carriage being perpendicular to the sides of the frame.

In one embodiment, the carriage rests on four guiding guides. The guiding guides rest on the bottom of the frame. The carriage may be provided with runners or wheels bearing on the guide.

In one embodiment, the carriage comprises a front edge provided with cutouts forming a housing for a chassis of the plate in the low position.

In one embodiment, the frame comprises a mechanical stop that limits the travel of the carriage, arrival at the stop generating a demand for current from the electric ram that can be detected by a control of the ram.

In one embodiment, the carriage and the mobile end of the ram are connected close to the edge of the carriage distant from the stationary end of the ram. The stability of the carriage while in movement is satisfactory.

In one embodiment, the chassis of the carriage is made from steel sheet having a thickness of between 1 and 4 mm.

In one embodiment, the plate comprises a chassis made from steel sheet having a thickness of between 1 and 4 mm.

In one embodiment, the frame is made from steel sheet having a thickness of between 1 and 4 mm.

In one embodiment, the arms are made from steel sheet having a thickness of between 1 and 4 mm.

In one embodiment, the flap is made from steel sheet having a thickness of between 1 and 4 mm.

Advantageously, the chassis of the carriage, the frame, the flap, the cover and the arms are made from steel sheet having the same thickness of between 2 and 3.5 mm, for example 3 mm.

In one embodiment, the plate comprises a chassis and an upper plate. The upper plate may serve for rolling or support a covering.

In one embodiment, the chassis of the plate comprises a lower surface bearing on the arms.

In one embodiment, the axis comprises a peg passing through a perforation provided in the body of the arm, and a base having a diameter greater than the diameter of the perforation. The base may be welded to a side of the frame.

Advantageously, the peg projects relative to the arm and enters a perforation provided in a cover parallel to said side wall of the frame.

In one embodiment, the frame comprises at least one metal sheet arranged between said side wall and the cover. The metal sheet stiffens said side. The metal sheet may be provided with perforations equivalent to the perforations of the cover and may form an extra thickness offering mounting clearance.

BRIEF DESCRIPTION OF THE DRAWINGS

Further features and advantages of the invention will become apparent upon examining the following detailed description and the appended drawings, in which.

Figure 1:
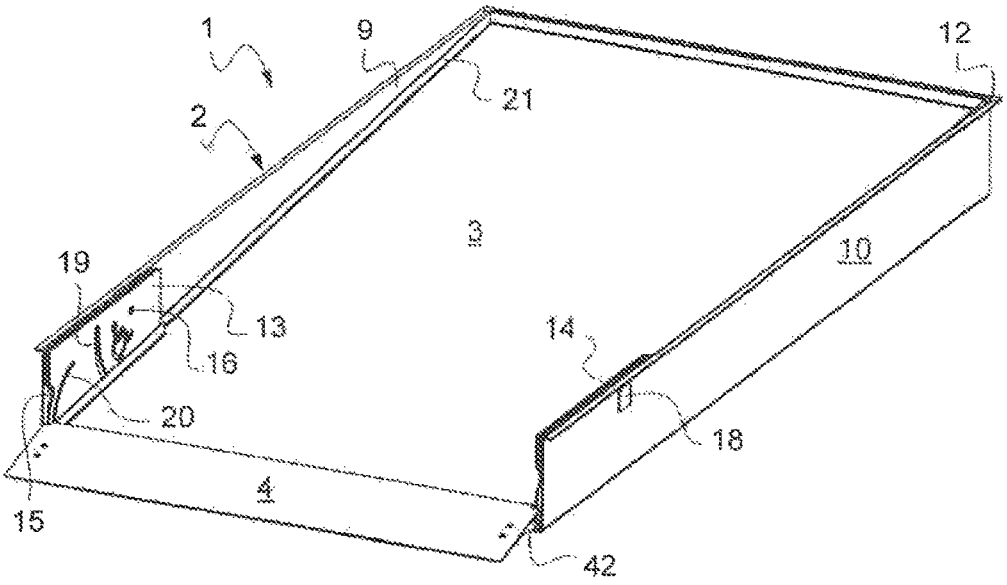
FIG. 1 is a schematic view in perspective of a device according to one embodiment, in the low position.

The appended drawings may be used not only to supplement the invention but also to contribute to its definition, as appropriate.

DETAILED DESCRIPTION

The object of the invention is to allow a change in level in the form of a step to be passed over. In the following text, the two levels will be distinguished by the expressions "upper floor" and "lower floor". The entry to a premises, a store, or an office often involves a difference in height in comparison to the exterior, be this a street open to motorized traffic, a pedestrian route, a square, etc. Persons using a wheelchair have to be able to gain access to this type of building. Those making deliveries using rolling platforms or carriages have the same requirement. In order to pass over a height of one or two steps, heavy-duty installations of the elevator type are not suitable. It is also appropriate to have regard to the appearance of facades, which are often subject to protection regulations, and to their alignment. The structure of the building has to be preserved to the greatest extent possible, in particular the upper-floor-load-carrying structure of the first floor into which entry is to be facilitated. A further, notable constraint arises from the fact that the basement is frequently unavailable, being used for other purposes or in the possession of third parties. The space available in terms of height is limited.

When the device is in the rest position, it has to remain within the dimensions of the preexisting structure. When the device is in use, the space taken up on the lower floor, a sidewalk for example, is small.

The help device 1 aims to make provision for the installation of a ramp having a slope of less than 20%, even less than 15, 10 or 5%, depending on regulatory or environmental constraints. The help device 1 is designed to be inserted or embedded in the upper floor, in front of the lower floor at the level of the access to be passed over.

The help device 1 comprises a frame 2 forming a box structure 7, inside which the ramp is accommodated. The ramp may have a lifting end, the ramp then being able to rock, as illustrated in the drawings.

The frame 2 has a substantially parallelepipedal general form of dimensions suited to the height of the step, to the width of the access and to the dimensions of the vehicle under consideration. For example, the box structure may have a height of the order of 5 to 30 centimeters, which allows insertion into the majority of floors, such as a concrete, brick or other type of slab.

The help device 1 comprises a plate 3 mounted in the frame 2. The upper plate constitutes a covering panel. The frame 2 is installed such that the upper plate forms a surface flush with the upper floor of the premises. The plate 3 may be produced so as to be harmonized with the rest of the upper floor, for example having regard to geometry, covering, decoration, etc.

The help device 1 comprises a front flap 4 forming a step façade surface. The front flap 4 is generally vertical in the high, or rest, position of the help device 1. The front flap 4 slopes in the active, or low, position of the help device 1. The front flap 4 of the device 1 may also have an appearance that is chosen in order to integrate into the building façade.

The frame 2 is stationary in the sense that it forms an immovable structure of the help device 1 in comparison to its installation environment, such as the floor or the sidewalk. The frame 2 comprises a bottom 8, parallel side walls 9, 10 forming the sides, a rear wall 11 and elements for supporting the plate 3. The term "rear" is used, here, in contrast to the front of the help device 1 designed to come close to a lower floor, for example a building façade. The term "rear" may also be seen as a synonym for "interior" in the case of a building. The rear wall 11 may be perpendicular to the bottom 8. The rear wall 11 is perpendicular to the side walls 9, 10. The side walls 9, 10 are perpendicular to the bottom 8. The box structure 7 may be made from steel sheet. The front ends of the bottom 8 and of the side walls 9, 10 define an opening of the box structure 7. Upon deployment, the flap 4 emerges from the box structure 7 through the opening. The opening is closed by the flap 4 in the rest position.

As a general rule, the bottom 8 is mounted in a housing provided for this purpose in the upper floor of the premises, slightly sloping toward the exterior, for example by approximately 1 to 3°. A slight slope facilitates evacuation, under gravity, in the event of accidental infiltration of liquid into the box structure 7. Furthermore, the depth of the housing to be hollowed out in order to accommodate the help device 1 is reduced at the rear.

As illustrated in FIG. 1, the help device 1 is in the low position. The rear end or second end of the plate 3 remains substantially at the same height as the top of the rear wall 11. The front end or first end of the plate 3 is lowered. The front end of the plate 3 rests on the bottom 8. The front flap 4 is in an erect position. The front flap 4 projects relative to the frame 2. The front flap 4 has a lower end projecting forward and an upper end close to the front end of the plate 3.

The side walls 9, 10 and the rear wall 11 comprise a substantially horizontal upper border 12. Said upper border 12 is continuous. Said upper border 12 is obtained by folding. A weld may be provided at the corners.

The help device 1 comprises a pair of covers 13, 14 arranged parallel to the side walls 9, 10. The distance between the cover 13, 14 and the corresponding side wall 9, 10 is of the order of 6 to 12 mm. The distance between the cover 13, 14 and the corresponding side wall 9, 10 may be determined by washers or, preferably, by sheet-metal inserts of a form close to the form of the covers 13, 14. The inserts reinforce the cover and the side wall. Apertures are provided in the inserts to accommodate the parts arranged between the cover 13, 14 and the side wall 9, 10, in particular the arms below. The cover 13, 14 is fastened to the corresponding side wall 9, 10, for example by screws (not shown). The covers 13, 14 also form the sides. The covers 13 and 14 are arranged in the box structure 7. The covers 13 and 14 are arranged so as to be flush with the front end of the side walls 9, 10. The covers 13 and 14 extend between the bottom 8 and the upper border 12. The covers 13 and 14 rest on the bottom 8. The covers 13 and 14 extend from the front end of the box structure 7 toward the rear over a distance of less than 50% of the distance between the opening and the rear wall 11. The covers 13 and 14 have a rectangular shell. Each cover 13, 14 is flat. Each cover 13, 14 is made from cut-out metal sheet. Each cover 13, 14 has a notch 15 on a front edge. The notch 15 allows the articulation of the flap 4 to return into the box structure in the high position of the plate 3.

Figure 10:
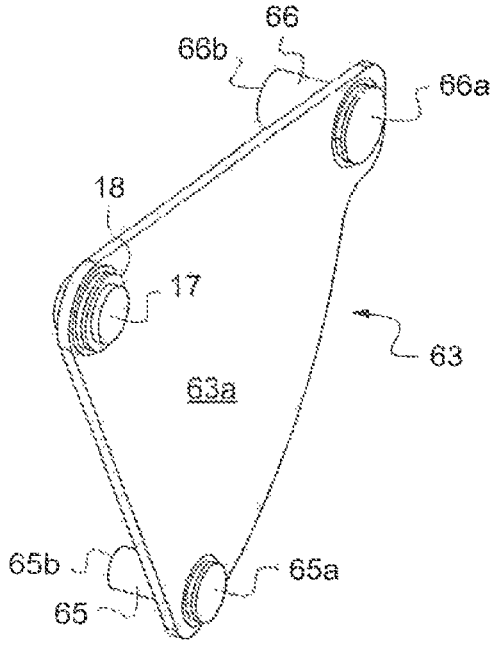
FIG. 10 is a schematic view in perspective of an arm.

Each cover 13, 14 is provided with a perforation 16 close to a rear edge of the cover. The perforation 16 is near to the upper edge 13. The perforation 16 serves to accommodate a peg 17 forming an axis of articulation. The peg 17 comprises a widened base 18. The base 18 is fastened to the corresponding side wall 9, 10, for example by welding, on the exterior side of the side wall 9, 10. The peg 17 comprises an axisymmetrical body (see FIG. 10). The body projects into the perforation 16. The body may bear on the cover 13, 14.

Each cover 13, 14 has an aperture 19 in the form of an arc of a circle. The aperture 19 is upwardly concave. The aperture 19 is distant from the front and rear ends of the cover 13, 14. The aperture 19 is distant from the upper and lower ends of the cover 13, 14. The aperture 19 extends over an angle of approximately 120°. The aperture 19 is centered on the perforation 16. The aperture 19 has a substantially vertical front end. The aperture 19 has a front end close to the upper edge 13. The aperture 19 has a rear end, concealed by the plate 3 in FIG. 1, close to the bottom 8 and to the rear end of the cover 13, 14. The lower zone of the aperture 19 is located plumb with the perforation 16.

Each cover 13, 14 has an aperture 20 in the form of an are of a circle, forming a guide. The aperture 20 is downwardly concave. The aperture 20 is distant from the front and rear ends of the cover 13, 14. The aperture 20 is distant from the upper and lower ends of the cover 13, 14. The aperture 20 extends over an angle of approximately 60°. The aperture 20 is centered on a geometric point located in the cover 13, 14. The aperture 20 has a substantially vertical front end. The aperture 20 has a front end close to the bottom 8 and to the front end of the cover 13, 14. The aperture 20 has a rear end close to the upper edge 13 and to the front end of the aperture 19. The lower zone of the aperture 19 is located plumb with the notch 15.

Figure 2:
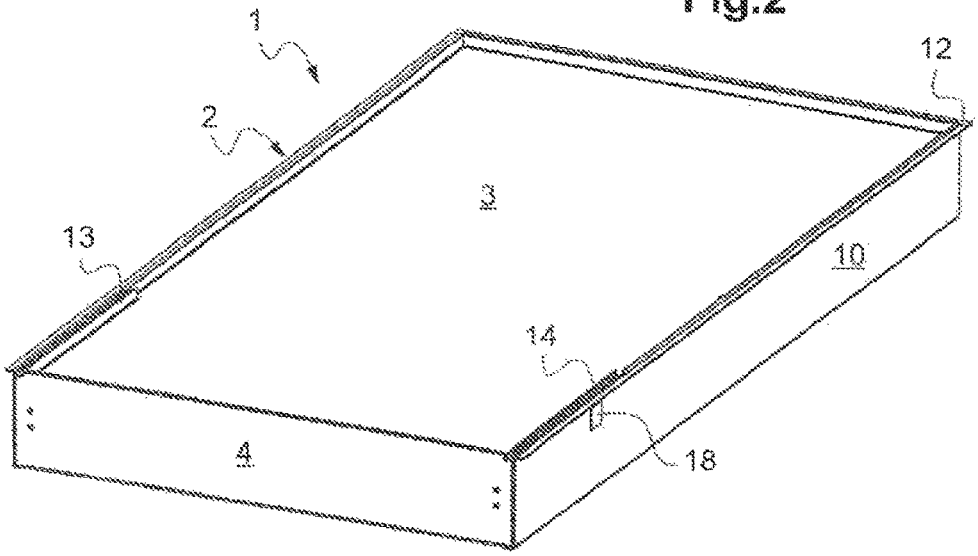
FIG. 2 is a schematic view in perspective of the device of FIG. 1, in the high position.

As illustrated in FIG. 2, the help device 1 is in the high position. The rear end of the plate 3 remains substantially at the same height at the top of the rear wall 11. The plate 3 is substantially horizontal. The front flap 4 is substantially vertical. The front flap 4 is in the retracted position: The front flap 4 is flush with the opening of the frame 2. The lower end of the front flap 4 is in contact with or in the immediate vicinity of the front end of the bottom 8. The front flap 4 comprises small sides in contact with or in the immediate vicinity of the front end of the side walls 9, 10. The upper end of the front flap 4 is close to the front end of the plate 3. The upper end of the front flap 4 is articulated at the front end of the plate 3.

The plate 3 may comprise a chassis and an upper sheet. The plate 3 is articulated about a horizontal axis close to the rear wall 11 and located under the plate 3. The plate 3 comprises a substantially rectangular principal surface with parallel elongate notches allowing the passage of the covers 13 and 14. The plate 3 comprises an upwardly facing border 21. The border 21 runs around the periphery of the principal surface. The border 21 has a constant of a few centimeters, for example 1 to 4 cm, enabling the plate 3 to receive a covering, for example a covering of stone slabs, wood flooring, laminate, a flexible synthetic covering, etc. The plate 3 may be made from steel sheet of a thickness between 1 and 4 mm, preferably between 2 and 3.5 mm.

Figure 3:
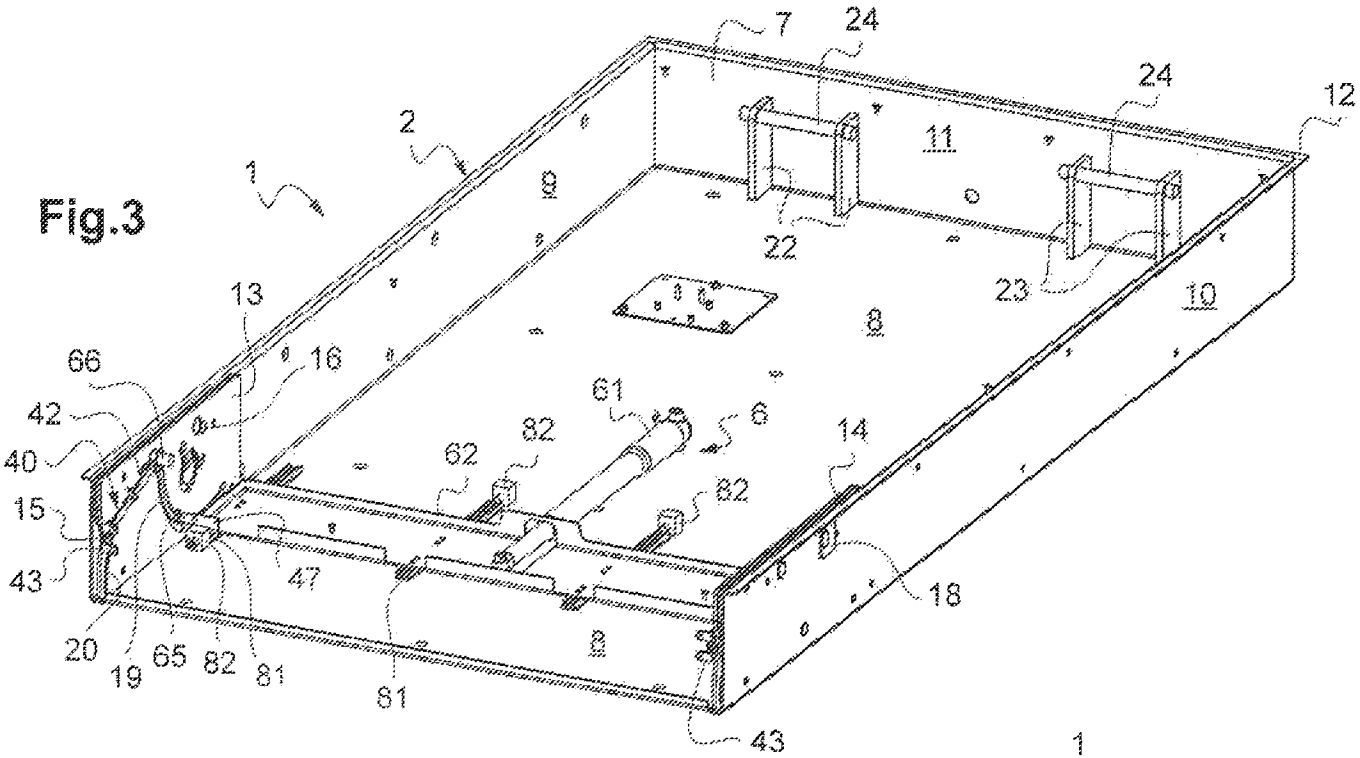
FIG. 3 is a schematic view in perspective of the device of FIG. 1 without the plate, in the high position.

FIG. 3 shows the help device 1 without the plate. The help device 1 is in the high position. The help device 1 comprises a drive assembly 6, which can be seen here. The drive assembly 6 may comprise a ram 61, a movable carriage 62 and a pair of arms 63. The ram 61 drives the movable carriage 62. The movable carriage 62 drives the arms 63. The ram 61 and the movable carriage 62 are arranged between the bottom 7 and the plate 3. The ram 61 is linear. The ram 61 is preferably electric. However, the variant with a mechanical ram actuated manually, for example using a crank, is possible. The ram 61 is parallel to the bottom 7. The ram 61 is parallel to the side walls 9, 10. The ram 61 comprises a stationary end facing toward the rear of the frame and a mobile end facing toward the front of the frame, i.e. the opening. The stationary end of the ram 61 is fastened to the bottom 8. The mobile end of the ram 61 is fastened to the carriage 62, for example close to the front edge of the carriage 62, for example close to the front edge of the carriage 62. The ram 61 is commanded by a control (not shown). The control may be provided with a current-detection device.

Figure 4:
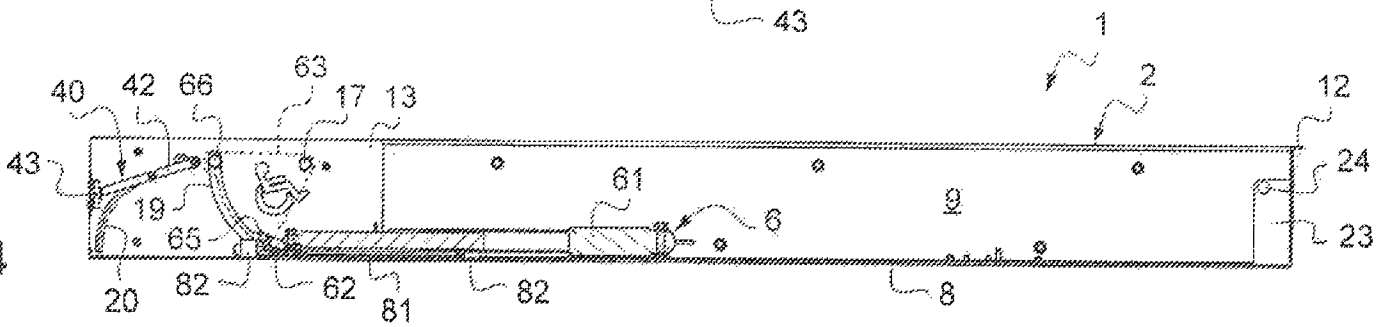
FIG. 4 is a schematic view in cross section, in a plane parallel to the side walls of the device of FIG. 1 without the plate, in the high position.
Figure 5:
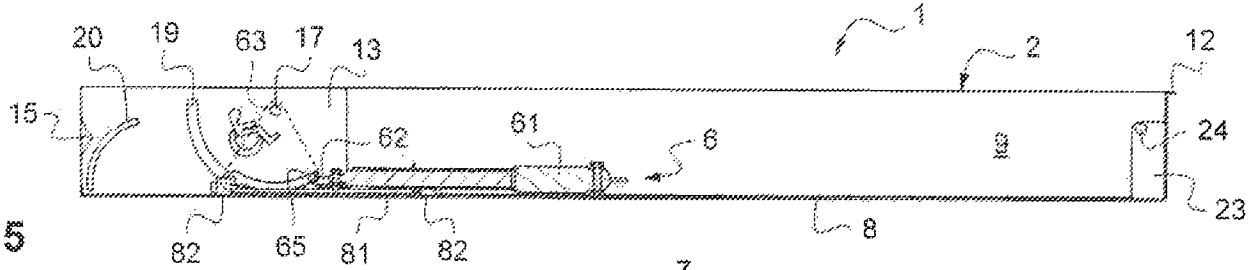
FIG. 5 is a schematic view in cross section, in a plane parallel to the side walls of the device of FIG. 1 without the plate, in the low position.
Figure 6:
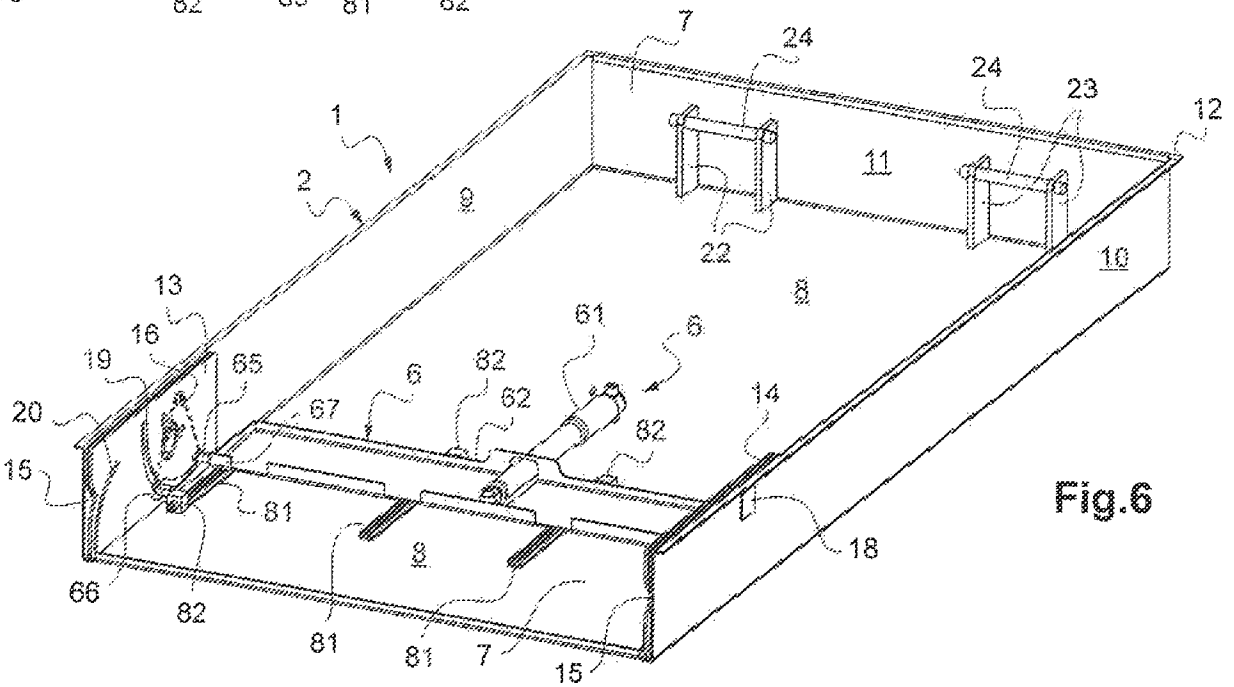
FIG. 6 is a schematic view in perspective of the device of FIG. 1 without the plate, in the low position.
Figure 7:
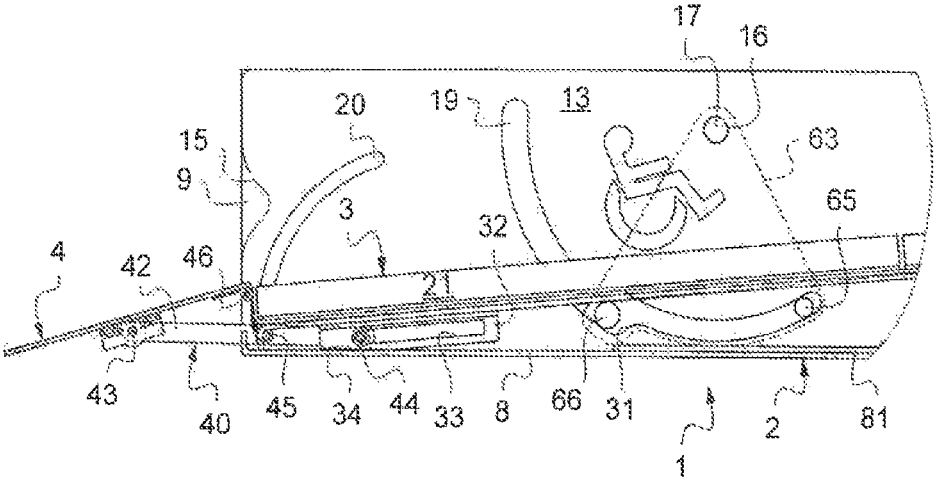
FIG. 7 is a schematic, detailed view in cross section, in a plane parallel to the side walls of the device of FIG. 1, in the low position.
Figure 8:
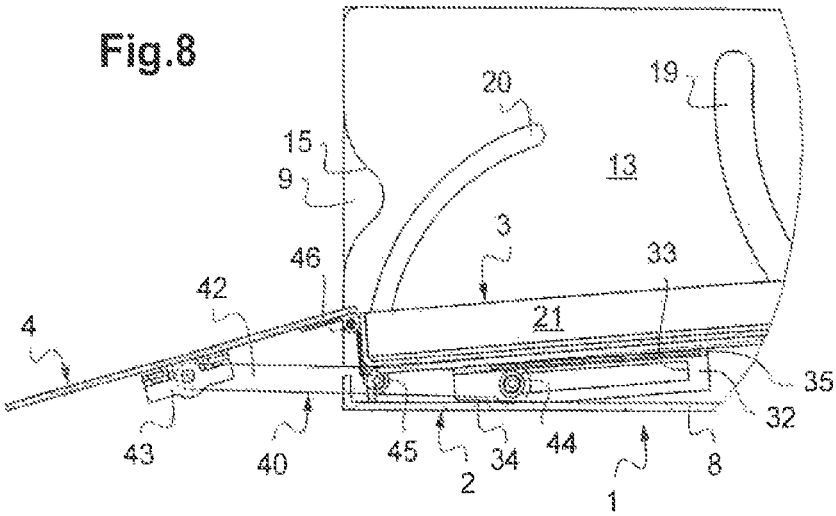
FIG. 8 is an enlargement of FIG. 7.
Figure 9:
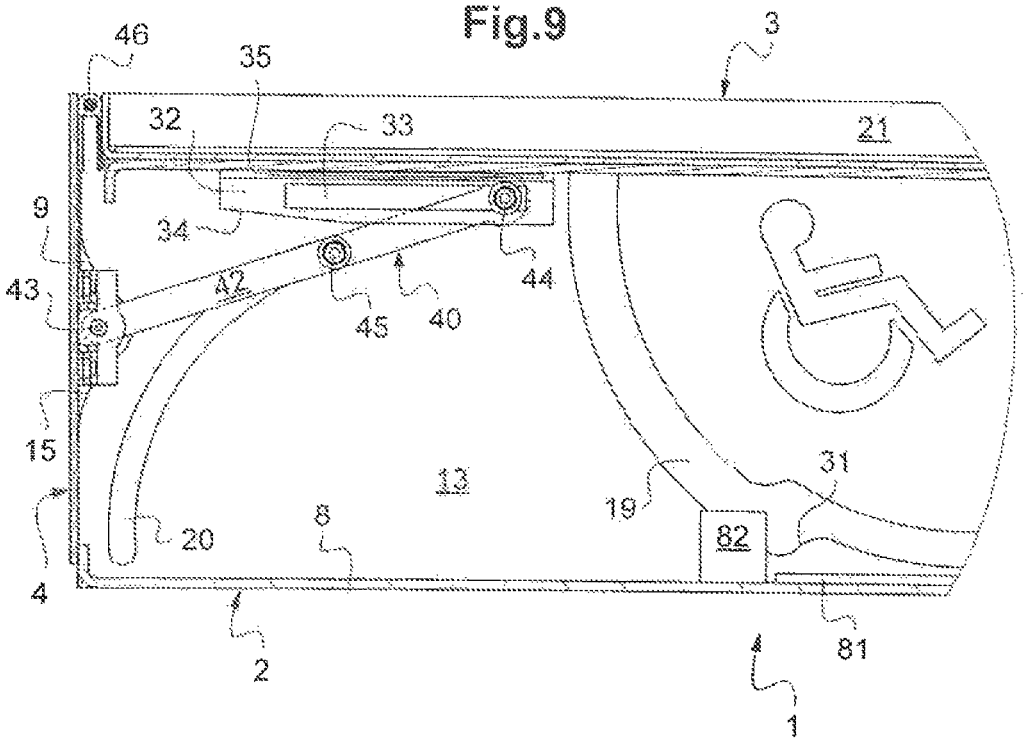
FIG. 9 is a view similar to FIG. 8 of the device, in the high position.

The mobile end of the ram 61 and the carriage 62 are movable in horizontal translation between a front position (see FIGS. 3, 4 & 9) and a rear position (see FIGS. 5 to 8). The front position defines a high position of the plate 3. The rear position defines a low position of the plate 3.

The carriage 62 rests on guides 81 mounted on the bottom 8. The guides 81 are horizontal. The guides 81 are parallel. Here, the guides are four in number. Embodiments with two or three guides are envisaged. The guides 81 may have the form of a metal profile section with a smooth, hard upper sliding surface. The carriage 62 has two runners per guide. The runners arranged under the carriage 62 are not visible. The runners may be made from synthetic material with a low coefficient of friction, for example based on PTFE.

The carriage 62 has a rectangular general form. The length of the carriage 62 is oriented between the side walls 9, 10, parallel to the rear wall 11. The width of the carriage 62 is oriented parallel to the side walls 9, 10. The length is greater than the width.

The carriage 62 comprises a chassis made from cut-out, folded metal sheet. The chassis comprises a rectangular bottom and longitudinal and lateral edges. The chassis of the carriage is made from steel sheet of a thickness between 1 and 4 mm, preferably from 2 to 3.5 mm. The longitudinal and lateral edges are substantially vertical. The longitudinal and lateral edges are folded upward. The longitudinal and lateral edges extend over a height of from 1 to 4 centimeters. The rear longitudinal edge comprises an aperture into which the ram 61 passes. The mobile end of the ram 61 is fastened to the bottom of the frame 2 close to the front longitudinal edge, making the carriage stable. Depending on the diameter of the ram, the aperture may also extend into the bottom in order to reduce the overall height. The front longitudinal edge comprises a plurality of cutouts, which are four in number, here, which, in the low position of the plate 3, accommodate profile sections forming beams on the underside of the plate 3. One cutout per profile section is envisaged. The front longitudinal edge comprises end regions close to the lateral edges and capable of bearing on the lateral edges. The end regions form pushers 67 for the arms 63. The pushers 67 are, here, vertical. The carriage 62 is symmetrical relative to a plane parallel to the side walls 9, 10.

The frame 2 comprises at least one mechanical stop 82 limiting the travel of the carriage, arrival at the stop generating a requirement for current to the electric ram which is detected by the control of the ram 61. Here, four mechanical stops 82 are arranged on the bottom 8. Each mechanical stop 82 is mounted at the end of a guide 81, some on the front side and the others on the rear side.

As shown in FIG. 3, the articulation of the plate on the frame 2 may be achieved as follows. The frame 2 comprises two pairs of vertical platens 22, 23. Each platen 22, 23 has the form of a rectangular flat part, for example made from metal sheet. Each platen 22, 23 rests on the bottom 8 via a small side. Each platen 22, 23 is in contact with the rear wall 11 via a large side or edge face. The platens 22, 23 may be welded to the bottom 8 and/or to the rear wall 11. A perforation of horizontal axis is provided in an upper zone of each platen 22, 23. The frame 2 comprises a segment of axis of pivoting 24 for each pair of platens 22, 23. Each end of a segment of axis of pivoting 24 projects into the perforation of a platen. Each segment of axis of pivoting 24 may be held in the perforations by circlips, retainer rings or internally toothed washers. Each segment of axis of pivoting 24 is supported by a pair of platens. The segments of axis of pivoting 24 are close to the upper end of the rear wall 11. The segments of axis of pivoting 24 are separated to ensure good stability. The plate 3 rests on the segments of axis of pivoting 24. The plate 3 may be secured to the segments of axis of pivoting 24 by flanges. The plate 3 is mounted so as to pivot relative to the frame 2. Pivoting takes place over a limited angle, for example less than 15°, so that the distance between the rear end of the plate 3 and the rear wall 11 remains insignificant, for example less than 3 mm.

The arms 63 are symmetrical. The arms 63 are coaxial. Each arm 63 is arranged between the side wall 9, 10 and the adjacent cover 13, 14. Thus, the arm is accommodated in a side of the frame 2. Each arm 63 is articulated on a peg 17 forming a rocking axis. The peg 17 is supported by the side wall 9, 10 and the cover 13, 14. The peg 17 is arranged in the upper region of the cover 13, 14. The peg 17 is arranged in the rear region of the cover 13, 14. The pegs 17 are coaxial. The pegs 17 are perpendicular to the side walls 9 and 10. The pegs 17 are horizontal.

Each arm 63 has a triangular general form or the form of a portion of a circle. Each arm 63 comprises a planar body 63*a*. The body 63*a* is made from a cut-out metal-sheet blank. Folding or drawing are avoided. The body 63*a* may have a thickness of between 1 and 4 mm. The body 63*a* is articulated on the peg 17. The peg 17 is arranged close to an apex of the triangle, the base of the triangle being closer to the bottom 8. Said apex has an angle of between 50 and 70°. Each arm 63 comprises a first finger 65 receiving the thrust of the pusher 67 of the carriage. The first finger 65 comprises a base 65*a* and a peg 65*b*. The peg 65*b* passes through a perforation in the body of the arm 63. The base 65*a* is welded onto said body on the side opposite the projection of the peg 65*b*. The base 65*a* has a solid disk form. The base 65*a* has a thickness of between 1 and 3 mm. The peg 65*b* has the form of a cylinder of revolution. The peg 65*b* may comprise a journal in order to reduce friction. The peg 65*b* may have a diameter of between 8 and 20 mm, preferably between 8 and 12 mm. The first finger 65 is arranged close to a second apex of the triangle.

Each arm 63 comprises a second finger 66 supporting the plate 3 close to the first end thereof. The second finger 66 receives the thrust of the plate 3 and drives the pivoting of the plate 3. The second finger 66 comprises a base 66*a* and a peg 66*b*. The peg 66*b* passes through a perforation in the body of the arm 63. The base 66*a* is welded to said body on the side opposite the projection of the peg 66*b*. The base 66*a* has a solid disk form. The base 66*a* has a thickness of between 1 and 3 mm. The peg 66*b* has the form of a cylinder of revolution. The peg 66*b* may comprise a journal in order to reduce friction. The peg 66*b* may have a diameter of between 8 and 20 mm, preferably between 12 and 16 mm. The second finger 66 is arranged close to a third apex of the triangle. The angle between a straight line passing through the peg 17 and the pusher 67 of the carriage, corresponding to the contact surface of the first finger 65, and a straight line passing through the peg 17 and the contact surface of the second finger 66 with the plate 3 is between 50 and 70°, preferably between 55 and 65°.

In one embodiment (not shown), the ends of the pegs 65*b* and 66*b* opposite the bases 65*a* and 66*a* are connected together by a spacer. The thickness of the body of the arms may be reduced.

The first finger 65 and the second finger 66 have parallel axes. The first finger 65 and the second finger 66 pass through the aperture 19. The first finger 65 and the second finger 66 project into the space located between the bottom 8 and the plate 3. The first finger 65 and the second finger 66 are arranged at different distances from the pegs 17. An amplifying device is thus formed. In the embodiment shown, the peg 17—first finger 65 distance is less than the peg 17—second finger 66 distance. There is an amplification of movement: the linear travel of the second finger 66 is greater linear than the travel of the first finger 65. The vertical travel of the front end of the plate 3 is greater than the horizontal travel of the ram, for example by 4%.

To that end, the aperture 19 has a recess 31 substantially at its center. The aperture 19 comprises a first portion for the travel of the first finger 65 and a second portion for the travel of the second finger 66. Here, the portions are contiguous, forming a single aperture. However, the first and second portions may be separate, hence two apertures, for example for a greater amplifying effect.

In the low position, the first finger 65 is located at the rear end of the aperture 19 and the second finger 66 is located at the rear end of the second portion close to the recess 31. The first finger 65 and the second finger 66 are substantially at the same distance from the bottom 8.

In the high position, the first finger 65 is located at the front end of the first portion of the aperture 19 close to the recess 31 and the second finger 66 is located at the front end of the aperture 19 close to the upper edge of the cover 13, 14. The first finger 65 and the second finger 66 define a straight line that slopes relative to the horizontal by approximately 50 to 70°.

The straight line passing through the peg 17 and the pusher 67 of the carriage, corresponding to the contact surface of the first finger 65, pivots from −30° to +30° in the course of the movement of the arm. This has the result that the distance between the first finger 65 and the bottom 8 varies by a maximum of 1-cos 30°, i.e. 13.4% of the radius between the peg 17 and the contact surface of the first finger 65 with the pusher 67 of the carriage. The vertical travel of the first finger 65 on the pusher 67 of the carriage is small. Thus, the pusher 67 of the carriage may have a small vertical dimension.

By construction, the straight line passing through the peg 17 and the point of contact between the second finger 66 and the plate 3 pivots by the same angle in the course of the movement of the arm. The horizontal travel of the second finger 66 on the plate 3 is small, of the order of 50% of the radius between the peg 17 and the contact surface of the second finger 66 with the plate 3.

In one alternative (not shown), the pivoting arms are replaced by sliding rods.

According to the invention, the flap 4 is articulated on the front end of the plate 3. To that end, a hinge 46 of substantially horizontal axis is provided. The hinge 46 is fastened first to the flap 4 near to an upper edge of said flap 4 and, second, to the plate 3. The fastening 3 may be effected at the border 21.

The help device 1 comprises a mechanism 40 for deployment of the flap 4. The mechanism 40 indexes the position of the flap 4 on the position of the plate 3. The mechanism 40 ensures closure of the flap 4 in the high position of the plate 3 and the deployment of the flap 4 in the low position of the plate 3. Here, "mechanism" is understood to mean a member without an electrical actuator. The mechanism 40 may optionally have a sensor. In the embodiment shown, the mechanism 40 has no sensor.

The mechanism 40 ensures an amplified movement at the start of the descent of the plate 3. Indeed, a given vertical movement of the front end of the plate 3 requires an at least equal vertical movement of the lower edge of the flap 4 in order to prevent too early a contact with the floor. The flap 4 being articulated at its upper edge, the required angular pivoting is high, the vertical movement following a law $H\times(1-\cos\alpha\ \alpha$, with $\alpha$ being the angle of the flap relative to the vertical and H the height of the flap). The mechanism 40 ensures a clearance at the end of the descent of the plate 3. Indeed, it is desirable for the flap 4 to enter into contact with the floor and to be able to adapt to floors of different levels. Mechanical adjustment by the installation operator is thus superfluous. The flap 4 being articulated at its upper edge, the required angular pivoting is low, the vertical movement following the same law, but with a being close to 90°.

The mechanism 40 comprises a pair of symmetrical rods 42, one rod on either side of the frame 2. Each rod 42 is an elongate part. Each rod 42 may be formed from a cut-out metal sheet blank and arranged as one or more thicknesses.

Each rod 42 comprises a front end articulated to the flap 4, a rear end mounted slideably relative to the plate 3, and a central portion mounted slideably relative to the frame 2. The front end of the rod 42 is linked to an articulation 43 distant from the top edge and from the bottom edge of said flap 4. Here, the articulation 43 is mounted substantially halfway between the top edge and the bottom edge of said flap 4. More generally, the articulation 43 is mounted between ⅓ and ⅔ of the height of the flap 4. The travel of the rod 42 is less than the travel of the bottom edge of the flap 4. The articulation 43 is arranged on the rear face of the flap 4, forming the lower face in the deployed position of the flap 4. The notch 15 of the cover 13, 14 forms a housing for the articulation 43 in the high position of the plate 3.

The rear end of the rod 42 is linked to a first slide 44 mounted slideably in a linear guide 32 of the plate 3. The rod 42 is able to move in rotation and in translation relative to the plate 3. The translational travel is limited by the length of the linear guide 32. The linear guide 32 is substantially horizontal in the high position of the plate 3. The linear guide 32 is parallel to the plate 3. The linear guide 32 comprises an elongate flat in which a rectilinear aperture 33 is provided. The linear guide 32 may comprise a metal-sheet part folded into a U, symmetrically relative to a central plane, each branch of the U having a rectilinear aperture 33. The bottom of the U is fastened to the plate 3 on the underside, for example by welding. Each branch of the U faces downward. Each branch of the U is parallel to the covers 13, 14. Preferably, a chamfer 34 is provided in each branch of the U in order to make it possible to achieve the low position of the plate illustrated in FIG. 7. The lower edge of the branches of the U is capable of coming to rest on the bottom 8.

Two parallel elongate slots 35 are provided in the linear guide 32. Each slot 35 is formed between a branch of the U and the base in the folding zone. Each slot 35 is longer than the length of the rectilinear aperture 33. Each slot 35 extends forward and backward from the rectilinear aperture 33. The slots 35 promote the bending of the branches of the U from a planar metal-sheet blank, reducing the likelihood of deformation close to the rectilinear apertures 33. Advantageously, said metal sheet is of the same thickness as the other principal parts.

A slide 44 is mounted between the linear guide 32 and the rod 42. The slide 44 has the form of a peg. The slide 44 comprises a base fastened to the rod 42, an axisymmetrical body arranged in the rectilinear aperture 33 and a head of larger diameter than the diameter of the body arranged on the side of the body opposite the rod 42.

The slide 44 may be symmetrical relative to the rod and comprise two bodies and two heads in order to interact with the two rectilinear apertures 33. The body may have a journal so that the slide 44 rolls over the edges of the rectilinear apertures 33. The rear end of the rod 42 is thus pivoting relative to the plate 3. The rear end of the rod 42 is sliding in translation over the length of the rectilinear apertures 33. In the high position of the plate 3, the linear guide 32 is located above the aperture 20. The linear guide 32 is located between the aperture 19 and the opening of the frame 2.

The central portion of the rod 42 is mounted pivotably and slideably relative to the frame 2. The aperture 20 forms a guide for that purpose. A slide 45 is mounted between the aperture 20 and the rod 42. The slide 45 has the form of a peg. The slide 45 comprises a base fastened to the rod 42, a body that is a cylinder of revolution arranged in the aperture 20 and a head with a diameter larger than the diameter of the body arranged on the side of the body opposite the rod 42. The body may have a journal so that the slide 45 rolls over the edge of the aperture 20. The central portion of the rod 42 is thus pivoting relative to the frame 2 and sliding in translation over the aperture 20.

In the high position of the plate 3, the slide 45 is located at the upper end of the aperture 20. The slide 44 is located substantially to the rear of the linear guide 32. The rod 42 is at an angle of the order of 10 to 30° relative to the horizontal. The flap 4 is closed, i.e. substantially vertical. At the start of the movement of descent of the plate 3, the rear end of the rod 42 descends, as does the front end, and the slide 45, in order to follow said descent, is forced to move forward into the aperture 20, which drives the rod 42 forward, in particular toward the front of the linear guide 32. The amplification of the horizontal movement of the rod 42 toward the front at this stage is obtained, in particular, by the slope of the upper end of the aperture 20. Amplification of the horizontal movement of the lower end of the flap 4 is also obtained by the positioning of the articulation on the flap 4.

A mirror-image of this situation obtains at the end of the ascent movement of the plate 3.

In the low position of the plate 3, the slide 45 is located at the lower end of the aperture 20. The slide 44 is located substantially at the front of the linear guide 32. The rod 42 is substantially horizontal. The flap 4 is open, i.e. projecting toward the front via its lower end, with a slope dependent on the configuration of the floor. At the end of the movement of descent of the plate 3, the rear end of the rod 42 descends. The front end of the rod 42 descends more slowly because the pivoting of the flap 4 toward front diminishes the amplitude of this movement. The slide 45 is located toward the front end of the aperture 20, on a near-vertical portion. The horizontal movement of the rod 42 toward the front is thus reduced relative to the vertical movement of the plate 3. Said near-vertical portion of the aperture 20 provides the flap 4 with significant clearance to adapt to different floors without special adjustment. At the start of the ascent movement of the plate 3, the flap 4 is able to remain bearing on the floor. The horizontal movement of the rod 42 is very small owing to the slope of the front end of the aperture 20.

There is an amplification of the horizontal movement of the rod 42 over the upper portion of the aperture 20 sloping at less than 45° relative to the horizontal and a reduction of the horizontal movement of the rod 42 over the lower portion of the aperture 20 sloping at more than 45° relative to the horizontal.

By virtue of the flap 4 and its deployment mechanism, maneuvering of the flap is safe, reliable and easy, since it is driven by the maneuvering of the plate.

The invention claimed is:

1. A device for helping a wheeled vehicle, in particular for a person with impaired mobility, to pass over an obstacle, characterized in that it comprises

- a stationary frame comprising a bottom and two side walls,
- a plate provided with two ends, a first end being movable between a high position and a low position in which said plate constitutes a first access ramp,
- an assembly for driving, in vertical translation, at as said first end, supported by said assembly,
- a flap forming a front face of the device in the high position of the plate and forming a second access ramp in the low position of the plate, the flap being mounted pivotably on the plate at the first end of said plate, and
- a mechanism of deployment of the flap, comprising at least one rod comprising a front end articulated on the flap, the articulation being distant from a top edge and from a bottom edge of said flap, a rear end linked to a first slide mounted slideably in a linear guide provided in the plate, and a central portion linked to a second slide provided in a side of the frame, the rod moving in a substantially vertical plane.

2. The device as claimed in claim 1, wherein the slides are pegs.

3. The device as claimed in claim 1, wherein the linear guide is substantially horizontal in the high position of the plate.

4. The device as claimed in claim 1, wherein the guide of the frame is in the form of an arc of a circle with a substantially vertical lower end.

5. The device as claimed in claim 4, wherein the guide of the frame has an upper end sloping by an angle of between 50 and 75° relative to the vertical.

6. The device as claimed in claim 1, wherein the axis of articulation of the flap is arranged at a height of between 40 and 60% of the distance between the top edge and the bottom edge of said flap, the rod sloping by an angle of between 10 and 35° relative to the horizontal in the high position of the plate and the rod being substantially horizontal in the low position of the plate.

7. The device as claimed in claim 1, wherein the rod is made from a cut-out metal-sheet blank.

8. The device as claimed in claim 1, wherein the rod is a rectilinear arm.

9. The device as claimed in claim 1, wherein the linear guide provided in the plate comprises an elongate flat in which a rectilinear aperture accommodating the first slide is provided.

10. The device as claimed in claim 1, comprising two symmetrical rods, one rod on either side of the frame.

11. The device as claimed in claim 1, wherein the drive assembly comprises:

- a linear ram mounted under the plate, provided with a stationary end close to said second end and rigidly connected to the bottom, and a mobile end,
- a carriage that is movable in horizontal translation and driven by said ram, said carriage resting on guides mounted on the bottom of the frame, said carriage comprising two pushers,
- a pair of arms, the arms being symmetrical, each arm resting on one of the pushers of the carriage, each arm supporting the first end of the plate; in the retracted position of the actuator, the carriage being close to said second end, the arms being in the low position and the first end being in the ramp position, and in the extended position of the actuator the carriage being close to said first end, the arms being in the high position and the first end being in the raised position.

12. The device as claimed in claim 11, wherein the arms are mounted pivotably on the side walls of the frame on a substantially horizontal common axis, each arm being accommodated in a side of the frame, each arm comprising a body made from a cut-out metal-sheet blank, and each arm comprises a finger receiving the thrust of the pusher of the carriage and a finger supporting the first end of the plate, each arm being mounted between a side wall of the frame and a cover parallel to said side wall, at least one aperture in the form of an arc of a circle being provided in said cover, the fingers projecting through said aperture, the axis of pivoting of the arm being supported bilaterally, each arm has a triangular form, an apex being located at the axis of pivoting, the angle formed between a straight line passing through the axis of pivoting of an arm and the pusher of the carriage and a straight line passing through the axis of pivoting of an arm and the arm-plate point of contact being between 50 and 70°, preferably the straight line passing through the axis of pivoting of an arm and the pusher of the carriage having an angular travel, in the course of pivoting, between 50 and 70°, and the straight line passing through the axis of pivoting of an arm and the pusher of the carriage sloping relative to the vertical, in the course of pivoting, by an angle of between −30 and +30°.

13. The device as claimed claim 11, wherein the carriage comprises a chassis made from folded metal sheet, the chassis comprising a base substantially parallel to the bottom of the stationary frame, a rear border provided with an aperture allowing the ram to pass through and a front border comprising two zones forming the pushers.

14. The device as claimed in claim 11, wherein the ratio of amplification of the arms is between 100 and 110%, each arm being mounted on a side of the frame on an axis fastened to said frame.

15. The device as claimed in claim 11, wherein the arms forming rods are mounted in an articulated manner on the carriage and on the plate.

16. The device as claimed in claim 1, wherein the plate comprises a second end mounted pivotably at the rear of the frame about a horizontal axis.

17. The device as claimed in claim 14, wherein the ratio of amplification of the arms is more than 100 and less than 105%.

18. The device as claimed in claim 4, wherein the arc of the circle has a radius between 30 and 280 mm.

* * * * *